United States Patent [19]

Jensen

[11] 4,414,775

[45] Nov. 15, 1983

[54] MAGNETIC KINETIC AMUSEMENT DEVICE

[76] Inventor: Flemming E. Jensen, 7911 NE. 33rd Ave., Unit 340, Portland, Oreg. 97211

[21] Appl. No.: 371,671

[22] Filed: Apr. 26, 1982

[51] Int. Cl.[3] ..... A63H 33/26

[52] U.S. Cl. ..... 46/241

[58] Field of Search ..... 46/236, 238, 241, 242, 46/239, 240, 45, 1 R; 273/1 M; 272/8 R, 8 N, 8 D; 335/209, 306

[56] References Cited

U.S. PATENT DOCUMENTS 2,523,351 9/1950 Armstrong ..... 46/241 UX 2,702,191 2/1955 Lemelson ..... 46/236 X

*Primary Examiner*—Mickey Yu

*Attorney, Agent, or Firm*—Eugene D. Farley

[57] ABSTRACT

A magnetic, kinetic amusement device is formed of a base, and a pair of magnetic members supported by resilient wire supports mounted on the base. The magnetic members are arranged separately in substantially vertical opposition to each other when in static condition but are mutually attractable into contact with each other, against the tension of their resilient wire supports, when moved into close proximity to each other by a prolonged oscillation induced by the opposing magnetic and resilient wire forces.

8 Claims, 3 Drawing Figures

MAGNETIC KINETIC AMUSEMENT DEVICE

BACKGROUND OF THE INVENTION

This invention relates to amusement devices. It pertains particularly to amusement devices of the class comprising a pair of magnetic members supported on resilient wire supports and characterized by the ability to move in a random and interesting manner relative to each other, the movement terminating in the collapsing of one magnetic member against the other as the members come within range of their respective fields of force.

It is the general object of the invention to provide such an amusement device which is simple in construction, characterized by an interesting but unpredictable movement of its component magnetic members, and characterized further by the ability to place its component magnetic members in a precise and predetermined position relative to each other as they collapse together under the influence of the magnetic attraction exerted by their respective fields of force.

DETAILED DESCRIPTION OF A SPECIFIC EMBODIMENT

The manner in which the foregoing and other objects of the invention are accomplished will be apparent from the accompanying specification and claims considered together with the drawings, wherein:

Figures 1, 2, 3:
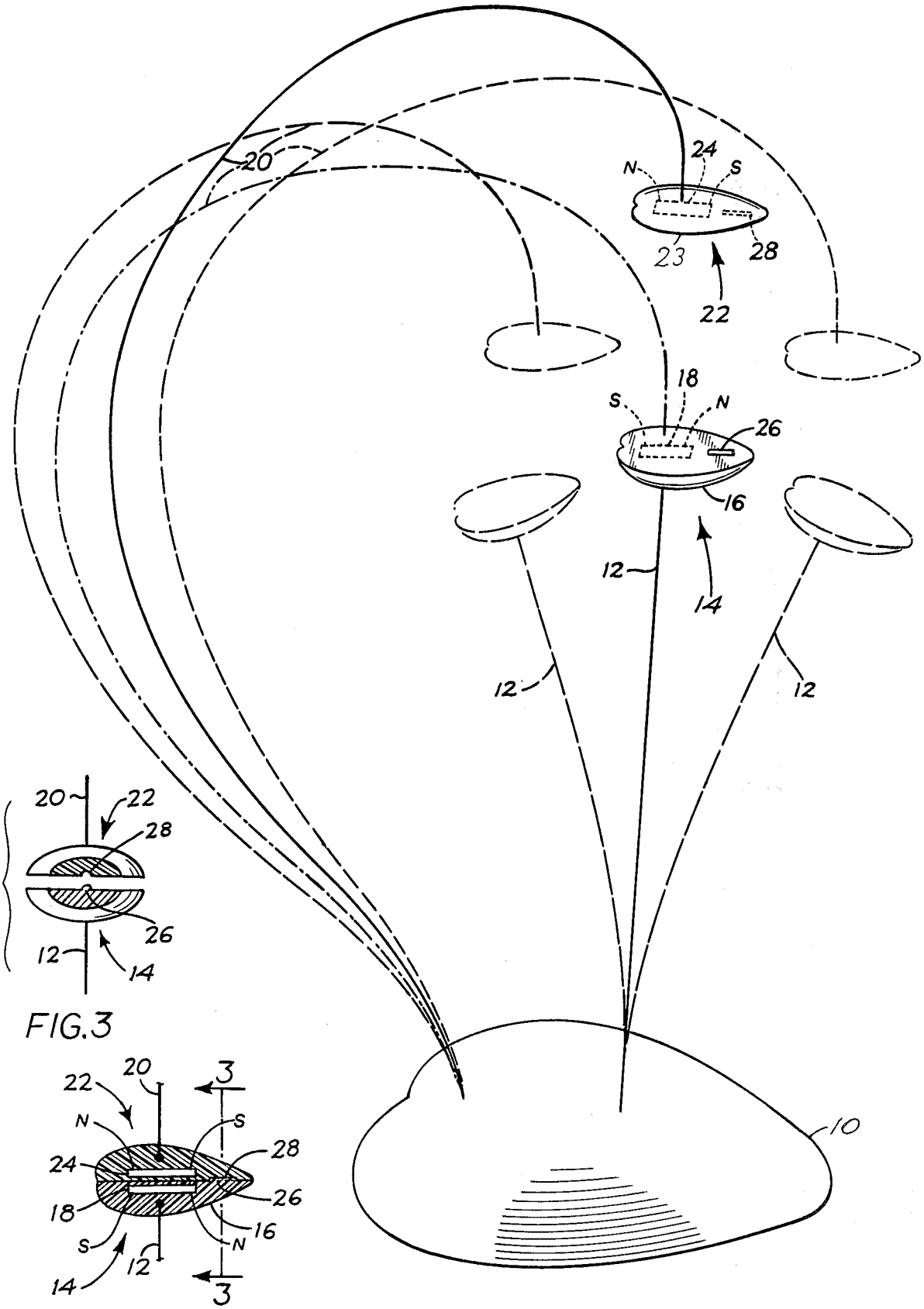
FIG. 1 is a top perspective view of the herein described kinetic, magnetic amusement device illustrating in phantom outline several of the multiplicity of positions which may be taken by the component magnetic members of the device as they move relative to each other during its operation.
FIG. 2 is a longitudinal, sectional view of the magnetic members of the device of FIG. 1 in their collapsed, contact position in which the members are held by magnetic attraction closely in contact with each other.
FIG. 3 is a transverse sectional view of the magnetic members in their separated position, taken along line 3—3 of FIG. 2.

The ensuing description pictures my invention in the embodiment of a valentine in which the component parts are heart shaped. However, it will be apparent that the device may be built and operated in many different designs to suit the purposes of the user.

In the illustrated embodiment, the device is mounted on a heart-shaped base 10 which may be made from plastic, wood, or other suitable structural material, preferably non-magnetic. For stability, it has a flat bottom and an upper surface contoured in the shape of a heart.

A first resilient wire support 12 is mounted on the base and extends upwardly therefrom. It preferably comprises a straight stiff piece of spring wire, such as piano wire, although other materials such as resilient plastic strips may be employed. However, the character of the support should be such as to permit its universal movement in all directions.

A first magnetic member 14 is secured to the upper or free end of wire support 12.

In the illustrated form of the invention this includes a body 16 made of plastic, wood, or other non-magnetic material. When viewed in plan, it is in the shape of a half heart, with the flat side facing upwardly.

Body 16 mounts a magnet 18 which preferably is of the Alnico permanent variety.

Also mounted on the base 10 is a second resilient wire support 20. This extends upwardly in a substantially continuously arcuate, reversely bent configuration to a plane above the plane of the first magnetic member. When viewed in elevation, in the embodiment illustrated, it assumes the configuration of a half heart. It, too, is fabricated from a resilient material such as spring steel, wire or springy plastic.

Wire support 20 mounts a second magnetic member 22. This member is complementary to magnetic member 14, and includes a body 23, heart shaped in contour when viewed in plan, and representing the other half of a heart arranged with the flat side facing downwardly.

Embedded in body 23 is a second magnet 24. This, too, preferably comprises a permanent magnet of the Alnico type.

Magnet 24 is arranged with its polarity opposite to the polarity of magnetic 18 so that the two magnets will exert a mutual magnetic attraction. Also, both magnets are mounted in their respective bodies in such a manner that, when the magnets are directly opposite each other in the positions to which they will be drawn by the interaction of their respective fields of force, the margins of bodies 16, 23 will be in substantially exact registration with each other so that the two half hearts will form a single whole heart in appearance.

Further to assist in the alignment and registration of the two parts, there are provided cooperating tongue and groove members on the opposed flat faces of body members 16, 23 which tend to guide the two members into exact registration as they are drawn together by magnetic attraction.

Accordingly, there is provided a tongue 26 on the upper, flat surface of body member 16 and a cooperating groove 28 on the lower flat surface of body member 23. Tongue 26 preferably has wedge-shaped, sloping surfaces, as does groove 28. As a result, during the approach to each other of the two magnetic members during the final stages of their movement, they will be guided into exact registration with each other, thus supplementing and reinforcing the alignment function of the magnets which they contain.

To achieve the desired result, i.e. an interesting and prolonged pattern of movement of the magnetic members under the influence of the tension of their resilient wire supports and the fields of force of the magnets, careful attention must be given to the strength and stiffness of the wires used in the fabrication of supports 12 and 20. In general, the gauge of wire 20 must be substantially greater than the gauge of wire 12.

Support wire 12 has for its function the support of magnetic member 14, and accordingly should be stiff enough to accomplish this purpose and to give the magnetic member a whip-like motion as it oscillates over a substantial period of time. If it is too stiff, it will fail in its purpose.

Support wire 20, being of much greater length and being required to support magnetic member 22 directly opposite magnetic member 14, must be of a heavier gauge. Otherwise it will collapse too easily under the influence of the magnetic fields of force. On the other hand, if it is too stiff, it will not oscillate in the desired manner.

In practice, when using spring steel wire of the nature of piano wire, I have found that using a wire gauge measurement of from 10 to 30, preferably about 20, for support wire 12 and a gauge wire measurement of from 30 to 50, preferably about 40, for support wire 20, achieves the desired purpose.

OPERATION

In the operation of the magnetic, kinetic amusement device of my invention, magnetic members 14, 22 are adjusted relative to each other so that when the device is in its rest or static condition, the magnetic members are spaced apart at about the maximum distance at which their respective magnets have sufficient mutually attractive force to draw the two members together.

One of the magnetic members then is drawn to one side against the tension of its supporting spring, and released. This causes it to oscillate back and forth. As it does so, the magnetic member which it supports cuts through the fields of force of the companion magnetic member and induces in it an oscillation or vibration. An animated, pulsing kinetic result is produced, with the magnetic members oscillating to and fro in all planes, with the upper magnetic member additionally springing up and down so that a multiplicity of different positions are assumed, as illustrated by the dashed-line representation of FIG. 1.

As the oscillations and vibrations diminish, the effect of the magnetic fields of magnets 18, 24 becomes more dominant and eventually prevails, with the result that magnetic member 22 collapses onto magnetic member 14. As it does so, the lines of force of the fields of force of the respective magnets draw the two parts together into substantial registration, an effect which is made more precise by the guiding influence of tongue and groove members 26, 28 which ultimately key the two magnetic members together to form a completed whole which, in the illustrated embodiment, is a completed heart.

It will be understood while this invention has been described in terms of specific embodiments, variations may be made by those skilled in the art, which variations nevertheless are within the scope and spirit of this invention. For example, although reference has been made to the operation of the device in a vertical position, it may be operated also in positions other than vertical. The invention therefore is to be broadly construed within the scope and spirit of the following claims.

I claim:

1. A magnetic amusement device comprising:

(a) a base, (b) a first resilient wire support mounted on the base and extending upwardly therefrom, (c) a first magnetic member secured to the outer end of the first resilient wire support, (d) a second resilient wire support mounted on the base and extending upwardly in a substantially continuously arcuate, reversely bent configuration to a plane above the plane of the first magnetic member, and (e) a second magnetic member secured to the outer end of the second resilient wire support, (f) the first and second magnetic members being arranged separably in vertical spaced opposition to each other when in static condition, being mutually magnetically attractable into contact with each other against the tension of their resilient wire supports when moved into close proximity to each other, (g) whereby, upon moving one of the magnetic members away from the other and releasing it, prolonged to and fro up and down relative movement of the magnetic members occurs, induced by the attracting magnetic forces and opposing resilient wire forces, such relative movement eventually terminating in the releasable uniting of the magnetic members as the magnetic forces prevail.

2. The device of claim 1 wherein both magnetic members include magnets arranged with unlike poles opposite each other to draw the magnetic members into a predetermined position of registration when they come into contact with each other.

3. The device of claim 1 wherein one magnetic member includes a magnet and the other magnetic member includes a piece of magnetic material.

4. The device of claim 1 wherein the first resilient wire support comprises a length of substantially straight, stiff spring wire and the second resilient wire support comprises a second length of stiff, spring wire contoured in a half-heart shape when viewed in elevation.

5. The device of claim 1 wherein the magnetic members, when viewed in plan, comprise half-heart shaped, non-magnetic bodies mounting pieces of magnetic material.

6. The device of claim 1 wherein the magnetic members include tongue and groove aligning means positioned for guiding the magnetic members into a desired registration as they are attracted into contact with each other.

7. The device of claim 1 wherein the resilient wire supports are of a differential degree of stiffness predetermined to permit easy resilient movement of the first resilient wire support while preventing easy collapse of the second wire support as the magnetic members enter into each other's respective fields of force.

8. The device of claim 1 wherein the second resilient wire support is stiffer and stronger than the first resilient wire support, the first resilient wire support comprising a stiff steel wire having a gauge measurement of from 10 to 30 and the second resilient wire support having a gauge measurement of from 30 to 50.

* * * * *